US006344832B1

(12) United States Patent
Lotfy

(10) Patent No.: US 6,344,832 B1
(45) Date of Patent: Feb. 5, 2002

(54) FREQUENCY CONVERTER ARRANGEMENT FOR PARABOLIC ANTENNAE

(75) Inventor: Kamal Lotfy, Paris (FR)

(73) Assignee: Organisation Europenne de Telecommunications par Satellite Eutelsat, Paris (FR)

( * ) Notice: Subject to any disclaimer, the term of this patent is extended or adjusted under 35 U.S.C. 154(b) by 0 days.

(21) Appl. No.: 09/446,190

(22) PCT Filed: Apr. 19, 1999

(86) PCT No.: PCT/FR99/00918

§ 371 Date: Apr. 19, 2000

§ 102(e) Date: Apr. 19, 2000

(87) PCT Pub. No.: WO99/54958

PCT Pub. Date: Oct. 28, 1999

(30) Foreign Application Priority Data

Apr. 20, 1998 (FR) ..... 98 04927

(51) Int. Cl.[7] ..... H01Q 13/00

(52) U.S. Cl. ..... 343/786; 343/756; 343/773; 343/779; 343/840

(58) Field of Search ..... 343/756, 772, 343/773, 776, 779, 786, 840

(56) References Cited

U.S. PATENT DOCUMENTS 4,115,782 A 9/1978 Han et al. ..... 343/779
4,178,574 A * 12/1979 Edens et al. ..... 343/756
4,498,061 A * 2/1985 Morz et al. ..... 343/756
5,305,001 A * 4/1994 Wong et al. ..... 343/786
5,812,096 A 9/1998 Tilford ..... 343/781 R
6,121,939 A * 4/2000 Imaizumi et al. ..... 343/840
6,111,547 A * 8/2000 Gau et al. ..... 343/786

FOREIGN PATENT DOCUMENTS

EP 0 843 381 5/1998 ..... H01Q/25/00
WO 96 02953 2/1996 ..... H01Q/3/12

OTHER PUBLICATIONS

Abstract for WO 9506963.
Abstract for FR 2745661.

* cited by examiner

*Primary Examiner*—Don Wong
*Assistant Examiner*—Hoang Nguyen
(74) *Attorney, Agent, or Firm*—Browdy and Neimark

(57) ABSTRACT

The invention concerns a frequency converter arrangement for parabolic antennae receiving vertical and horizontal linear polarization signals, transmitted by two geostationary satellites not far from each other. The arrangement comprises two positive converter devices (5, 6) designed to receive the signal derived from a satellite, each device bearing means ensuring that the receiving antennae elements are oriented in the received signal plane and means to adapt to the different elevations of the two satellites, by rotating the converter device support. The arrangement is characterized in that the output portions (10) of the two converter devices (5, 6) are made in the form of a single-piece part (12) whereas the input portions (9) are separated and mounted selectively adjustable on the single-piece part (12), the arrangement being mounted rotating about an axis parallel to the two input portions (9).

8 Claims, 2 Drawing Sheets

FREQUENCY CONVERTER ARRANGEMENT FOR PARABOLIC ANTENNAE

The invention relates to a frequency converter arrangement for parabolic antenae that receive vertical and horizontal linear polarization signals, transmitted by two geostationary satellites being at a low distance from each other, of the type comprising two frequency converter devices designed to receive the signal issued from a satellite, each device bearing means for orienting the receiving antenna elements in the plane of the received signal and means for adapting the different elevations of the two satellites, by adjusting the support of the converter devices.

In known arrangements of this type, each low noise universal converter is produced, with its elements for receiving vertical or horizontal polarization signals, in the form of an autonomous unit, and the two converters are mounted on the support, as being orientable in order to be able to be positioned in the plane of the signals to be received, the support being itself movable for ensuring the adaptation to the differences of elevation of the two satellites.

These known arrangements have the drawbacks of a complex structure and a high manufacturing cost.

The purpose of the invention is to provide a converter arrangement which overcomes the drawbacks of the state of the art.

For reaching this aim, the arrangement according to the invention is characterized in that the output portions of the two converter devices are made in the form of a single-piece part, whereas the input portions are separated and mounted selectively to be orientable on the single-piece part, the arrangement being rotatably mounted about an axis that is parallel to the two input portions.

According to one feature of the invention, each input portion comprises means for converting linear polarization signals that are received into circular polarization signals, and the output portion of each device comprises means for converting circular polarization signals into linear polarization signals.

According to another feature of the invention, each input portion comprises a wave guide element mounted on an output wave guide element that is fixedly mounted on the single-piece part, in axial alignment with and angularly movable in relation to it.

The invention will be better understood and other aims, features, details and advantages thereof will appear more clearly in the following explicative disclosure made with reference to the accompanying diagrammatic drawings that are given only are examples for illustrating an embodiment of the invention and in which.

Figure 1:
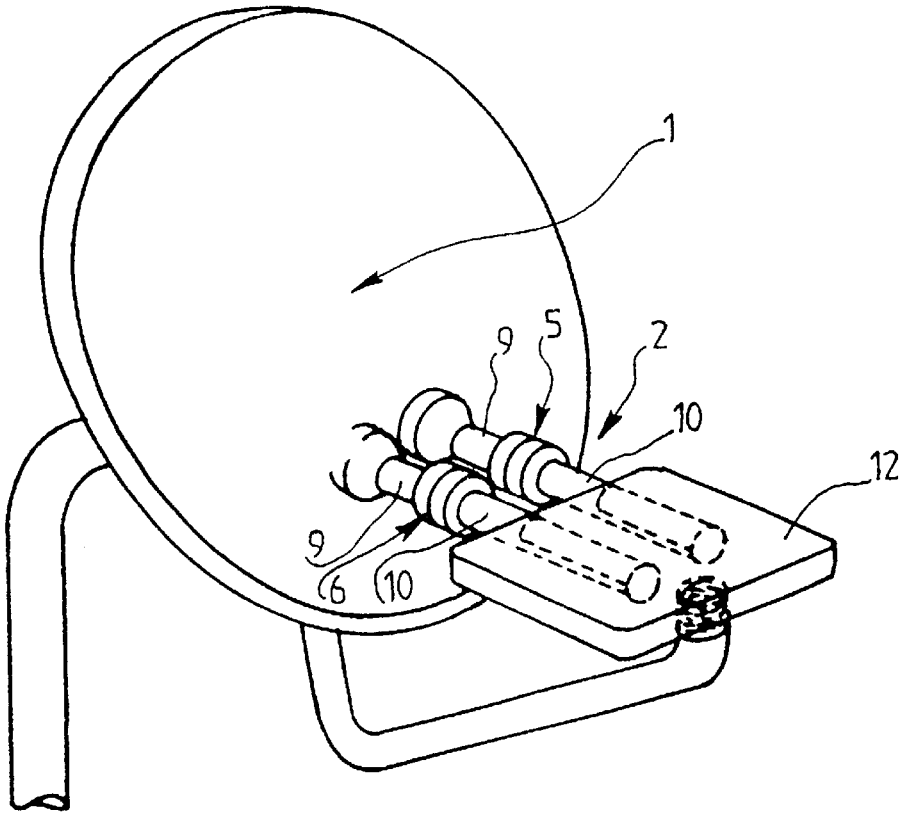
FIG. 1 is a perspective view of a parabolic antena fitted with a single-piece converter arrangement according to the present invention.

FIG. 1 shows a parabolic antena 1 fitted with a low noise source arrangement 2 according to the present invention. This arrangement is designed for enabling to receive horizontal or vertical linear polarization signals, transmitted by two geostationary satellites at a relatively low distance from each other. Each satellite can transmit on two frequency bands, a low band ranging from 10.7 GHz to 11.7 GHz and a high band ranging from 11.7 GHz to 12.75 GHz. The converter arrangement converts the full band of 11.7 to 12.75 GHz into a band of 0.950 to 2.150 GHz. The signals thus converted are transmitted to a receiver 3. This receiver can therefore receive signals transmitted by the satellite A1 (not shown), with horizontal or vertical linear polarization, being either in the low band or in the high band, and signals from the second satellite A2 (not shown) with horizontal or vertical linear polarization and being either in the low band or in the high band. When the user wants to select a program, he activates a selecting member in the receiver 3 which thus ensures the selection of the satellite A1 or A2, the vertical or horizontal polarization and the low or high band by sending an appropriate selecting signal, SA, SP and SB, respectively. These selecting signals will control a set of switches provided in the arrangement, as this will be seen upon disclosing the structure thereof.

Figure 2:
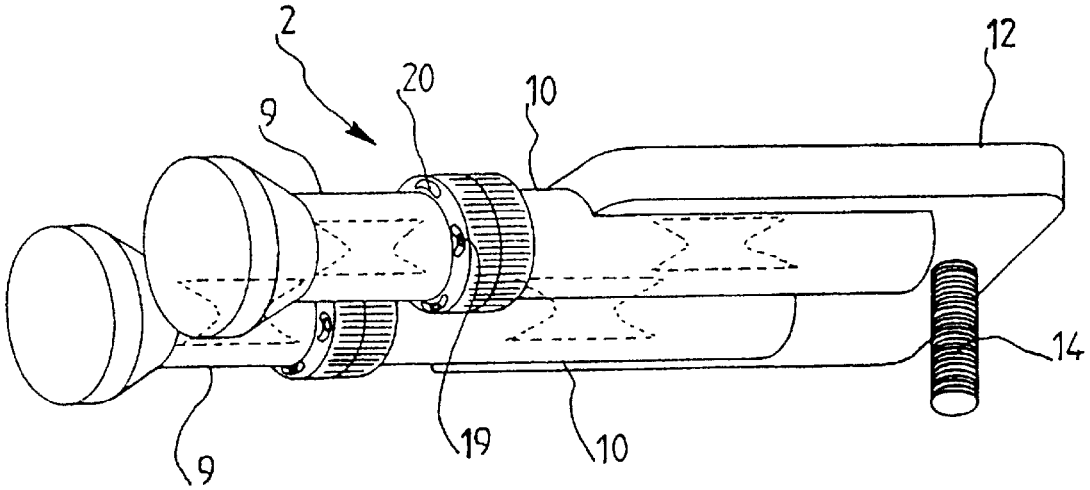
FIG. 2 is a perspective view of the single-piece arrangement according to the invention.
Figures 3, 4, 5:
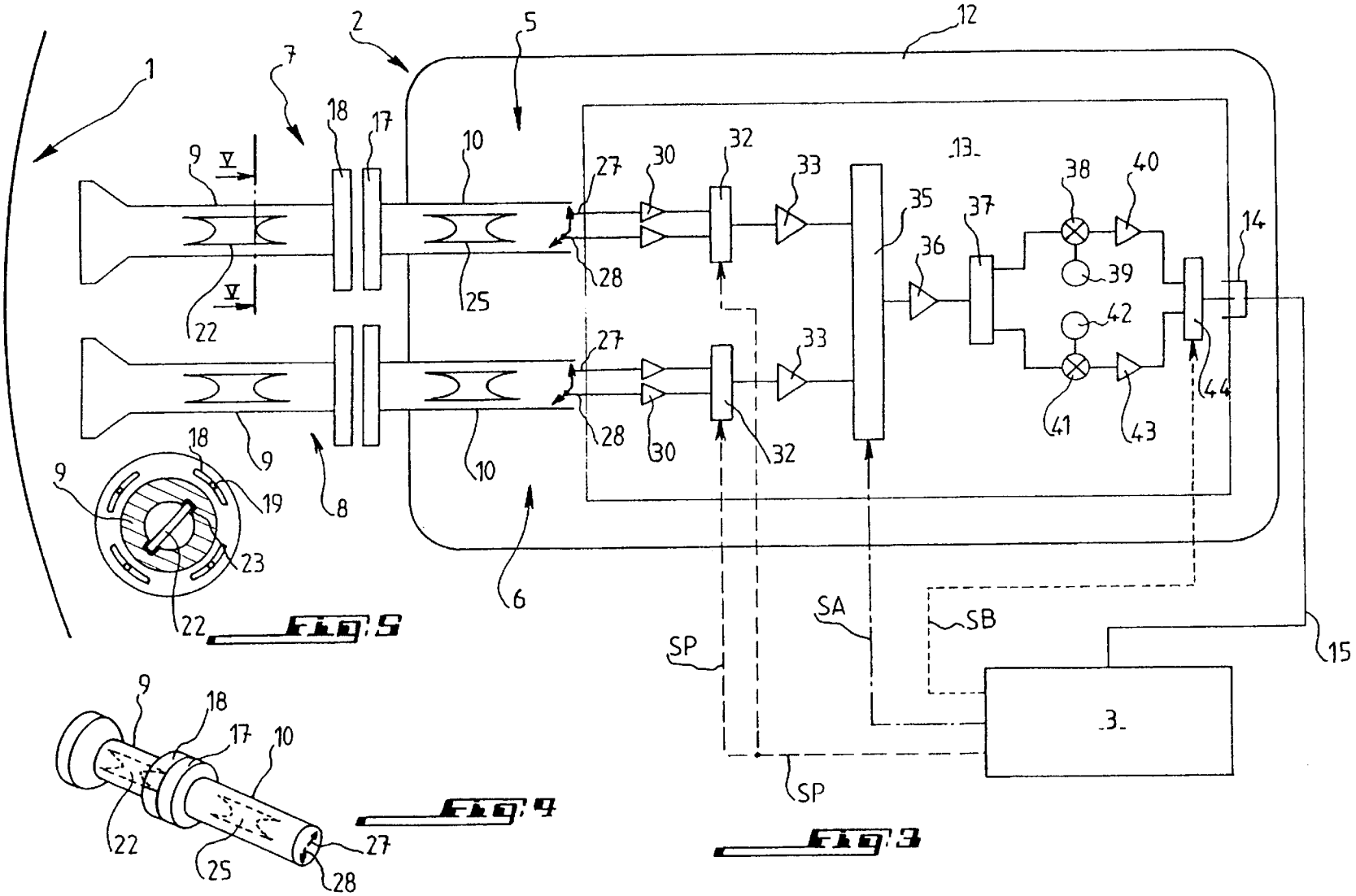
FIG. 3 is a diagrammatic view of the arrangement according to the invention.
FIG. 4 is a perspective diagrammatic view of a receiving wave guide of a converter according to the invention.
FIG. 5 is a cross sectional view along line V—V of FIG. 3.

As this is shown in FIGS. 2 and 3, the arrangement comprises two low noise converters 5 and 6, generally called LNB (Low Noise Block) in the art, each comprises a wave guide 7 and 8, respectivelly. Each wave guide 7 and 8 comprises a source forming input wave guide 9 and an output wave guide element 10. The elements 10 are fixedly mounted on the support casing 12 which houses the electronic device mounted on a printed circuit board 13. It is the output 14 of this plate which is connected to the receiver 3 by means of a coaxial cable 15.

Each input wave guide element 9 is axially aligned with the output element 10 and is angularly movable thereupon. For this purpose, the element 10 bears a flange 17 at its front end, and the rear end of the element 9 is provided with a flange 18. Assembling the two elements is made by connecting the two flanges 17, 18 with screws 19. For ensuring the rotation of the wave guide element 9 with respect to the output element 10, according to a predetermined angle, the passage opening for the screws 19 is made in the flange 18 in the shape of an arcuate oblong hole 20.

Each input wave guide element 9 is provided with means for converting vertical or horizontal linear position signals into circular polarization signals rotating in one or the other direction. These converter means are formed by a Teflon blade 22 extending inside the element 9 in the longitudinal direction thereof. The blade 22 is diagonally fixed in the element 9 by engaging its longitudinal edges in grooves 23 in the inner face of the element 9. The ends of the Teflon blade 22 are in the shape of dovetails. The two output wave guide elements 10 house also a Teflon blade shown at 25 which has substantially the same shape as the blade 22 and is mounted in the same way but angularly shifted by 90°. This blade 25 forms a means for converting circular polarization signals produced by the wave guide element 9 into vertical or horizontal linear polarization signals. At the rear end of the output wave guide element 10 and as better shown in FIG. 4, two antena elements 27, 28 made in the shape of points radially protruding inside the inner face of the element 10, while being angularly shifted by 90°, are provided. The element 27 is horizontally extended and is used for receiving horizontal polarization signals, whereas the element 28 is vertically oriented for receiving vertical polarization signals.

Referring to FIG. 3, there is found that the antenna elements 27 and 28 of each converter device 5, 6 are connected by means of an amplifier 30 to an input of a polarization switch 32 the output of which is connected, by means of an amplifier 33, to one of the two inputs of a position switch 35. An amplifier 36 connects the output thereof to input of a divider 37 which comprises a first output circuit comprising a mixer 38 to which is operativelly associated a local oscillator 39 and an amplifier 40 and a second output circuit which comprises a mixer 41/local oscillator 42 unit followed by an amplifier 43. The local oscillator 39 produces a signal of 9.75 GHz, and the oscillator 42 another signal of 10.6 GHz. Each output circuit is connected to one of the two inputs of a frequency band switch 44 the output of which is connected to the output terminal 14 of the arrangement which, on the other end, is connected to the receiver 3 by means of the coaxial cable 15.

It will be hereinafter described how works the converter arrangement which has just been described. It is assumed that the converter 5 is designed to receive signals from the satellite A1, and the converter 6 to receive signals from the satellite A2.

First, there is made sure that the plane of the signals from the satellite A1 or A2 will coincide with the orientation of the antenna elements 27, 28 of the converter 5 or 6. The adjustment is made by rotating the input wave guide element 9 of each converter according to the appropriate angle. The angular position of the support casing 12 is also adjusted as a function of the different elevations of the two antenae, by rotating the arrangement about an axis that is parallel to the input portions 9.

After this adjustment step, the arrangement is prepared for receiving the programs transmitted by the two satellites. In the receiver 3, each program is identified by the satellite A1 or A2 which transmits it, by the type of polarization which is vertical or horizontal, and by the low or high frequency band that the program will occupy.

When the user selects a program, the receiver 3 switches the polarization switch 32 of the appropriate converter on the type of polarization of the program signals. This switching operation is made by sending the appropriate polarization selection signal SP, i.e. a D.C. signal of 12 volts if the polarization is vertical or a signal of 18 volts if the polarization is horizontal. Then, after a predetermined time, the receiver will select the satellite A1, A2. This selection is made by sending or not a certain number of successive oscillation bursts that forms the signal SA of 22 kHz according to whether the programm is transmitted by one or the other satellite. Then, after a time used for selecting the satellite, the receiver tunes on the frequency band by sending the frequency band selecting signal SB to the switch 43 in the form of a modulation signal of 0 or 22 kHz. The above described control is known under the terms of DiSEqC (digital control of peripheral equipements in satellite reception).

As an example, the above described arrangement of the universal converter block according to the invention is particularly appropriate for the reception of satellites that are spaced apart by 6 degree. The arrangement may be used with antenae having a diameter of 80 cm and a F/D ratio of 0.6. The source arrangement is mounted on the antenna arm for enabling a relative elevation adjustment of one converter with respect to the other by +/−4 degree.

What is claimed is:

1. Frequency converter arrangement for a parabolic antenna that receives vertical and horizontal linear polarization signals transmitted by two geostationary satellites at a low distance from each other, said frequency converter arrangement comprising a support and two converter devices, each for receiving a signal issued from a respective one of the satellites, carried by said support, each converter device comprising an input portion, an output portion and receiving antenna elements carried by said output portion, and each converter device having means ensuring that the receiving antenna elements are oriented in the plane of the received signals and means for adapting to the different elevations of the two satellites by rotating said support, wherein: the output portions of the two converter devices are made in the form of a single-piece part, the input portions are separated and mounted to each be orientatable relative to the single-piece part; said means for adapting comprise means for rotating said support and said two converter devices as a unit about an axis that is parallel to the two input portions; each input portion comprises means for converting linear polarization signals that are received into circular polarization signals; and each output portion comprises means for converting circular polarization signals into linear polarization signals.

2. Arrangement according to claim 1, wherein each input portion comprises an input wave guide element, each output portion comprises an output wave guide element fixed to the single-piece part, and each input wave guide element is mounted on an associated output wave guide element in axial alignment with, and angularly movable in relation to, the associated output element.

3. Arrangement according to claim 1, wherein each said means for converting is formed by a blade that is mounted in a diametral plane of the associated wave guide element.

4. Arrangement according to claim 3, wherein each said blade is made of polytetrafluoroethylene.

5. Arrangement according to claim 4, wherein each output wave guide element has a circular cross section.

6. Arrangement according to claim 1, wherein said receiving antenna elements of each of said converter devices are disposed for receiving horizontal and vertical linear polarization signals.

7. Arrangement according to claim 6, further comprising: two polarization switches, each having two inputs and an output, said two inputs of each said polarization switch being connected to said antenna elements of a respective one of said converter devices; a satellite selection switch having two inputs and an output, each of said inputs of said satellite selection switch being connected to an output of a respective one of said polarization switches; two parallel circuits connected to said output of said satellite selection switch, each of said parallel circuits comprising a mixer and a local oscillator connected to said mixer; and a frequency band selection switch having inputs connected to said parallel circuits and an output.

8. Arrangement according to claim 7, further comprising a receiver connected to said output of said frequency band selection switch and further connected to control said two polarization switches, said satellite selection switch and said frequency band selection switch.

* * * * *